US005996192A

United States Patent [19]

Haines et al.

[11] Patent Number: 5,996,192

[45] Date of Patent: Dec. 7, 1999

[54] BUCKLE ASSEMBLY

[75] Inventors: Michael Haines, Essex; Adam Martyn Lloyd, Bucks, both of United Kingdom; Arthur L. Gehr, Jr., East Earl, Pa.

[73] Assignee: Graco Children Products, Inc., Elverson, Pa.

[21] Appl. No.: 09/201,959

[22] Filed: Dec. 1, 1998

[51] Int. Cl.[6] ..... A44B 11/25; A44B 17/00

[52] U.S. Cl. ..... 24/625; 24/630; 24/615

[58] Field of Search ..... 24/606, 615, 614, 24/625, 630–633, 573.5, 573.1, 312, 313, 315

[56] References Cited

U.S. PATENT DOCUMENTS

| | | | |
|---|---|---|---|
| D. 402,589 | 12/1998 | Lundstedt | D11/216 |
| 4,540,218 | 9/1985 | Thomas | 297/467 |
| 4,617,705 | 10/1986 | Anthony et al. | 24/642 |
| 4,692,970 | 9/1987 | Anthony et al. | 24/642 |
| 4,712,280 | 12/1987 | Fildan | 24/625 |
| 5,023,981 | 6/1991 | Anthony et al. | 24/573.5 |
| 5,038,446 | 8/1991 | Anthony et al. | 24/573.5 |
| 5,086,548 | 2/1992 | Tanaka et al. | 24/632 |
| 5,142,748 | 9/1992 | Anthony et al. | 24/573.5 |
| 5,182,837 | 2/1993 | Anthony et al. | 24/642 |
| 5,220,713 | 6/1993 | Lane, Jr. et al. | 24/628 |
| 5,274,890 | 1/1994 | Shimizu et al. | 24/603 |
| 5,279,505 | 1/1994 | Goudreau et al. | 24/573.1 X |
| 5,283,933 | 2/1994 | Wiseman et al. | 24/642 |
| 5,406,681 | 4/1995 | Olson | 24/573.5 X |
| 5,438,737 | 8/1995 | Anscher et al. | 24/630 |
| 5,507,076 | 4/1996 | Anscher | 24/625 |
| 5,590,444 | 1/1997 | Krauss | 24/625 |
| 5,604,964 | 2/1997 | Aoshima | 24/632 |
| 5,659,931 | 8/1997 | Anscher | 24/614 |
| 5,813,097 | 9/1998 | Woellert et al. | 24/631 |

OTHER PUBLICATIONS

Pages 6 and 10, Buckles; Century Products Company, 9600 Valley View Road, Macedonia, Ohio 44605. Publication date 1997.

*Primary Examiner*—James R. Brittain
*Assistant Examiner*—Robert J. Sandy
*Attorney, Agent, or Firm*—Foley & Lardner

[57] ABSTRACT

The present invention provides a buckle assembly which includes a first tongue, a second tongue, and a socket having a cavity for receiving at least a portion of the first tongue and second tongue. Each tongue includes a tongue coupling member which operates to register the first tongue and second tongue to be inserted into the socket simultaneously. Alternatively, the first tongue and second tongue may be inserted separately wherein the tongue coupling member allows the tongues to be slid relative to one another thereby facilitating individual insertion of the first tongue and the second tongue. In addition, the buckle assembly includes a securement member having a button on each tongue. Both the button on the first tongue and the button on the second tongue must be simultaneously actuated to eject the tongues from the socket. Further, the buckle assembly provides a first slot, a second slot, and a third slot configured to receive a corresponding belt. The slots are oriented relative to one another such that the buckle assembly operates as a five point restraint.

5 Claims, 4 Drawing Sheets

BUCKLE ASSEMBLY

BACKGROUND OF THE INVENTION

1. Field of the Invention

The present invention relates to safety restraint assemblies. Specifically, the present invention relates to buckle assemblies for releasably securing an individual such as an infant, or the like to a device such as a car seat, stroller or the like.

2. The Prior Art

Buckle assemblies, or harnesses, are well known in the art and are often utilized to secure an individual such as an infant to a variety of devices such as a car seat, stroller or the like. Traditionally, buckle assemblies include a two-piece buckle having a single tongue and a single socket to releasably join ends of a belt about the occupant. In addition, it has been found desirable, particularly when the occupant is an infant, to provide buckle assemblies which have multiple tongues to secure a plurality of belts together at a single junction or socket.

One such prior art device is disclosed in U.S. Pat. No. 5,659,931 to Anscher. Anscher discloses a three-piece buckle having a socket member and two plug members, wherein each plug member has a resilient tongue which defines an aperture or other opening disposed at a distal end thereof. The socket member includes a lug or pin which is adapted to fit into the aperture to lock the plug member into the socket member. Further, Anscher discloses including a hinged plate or button in a top face of the socket which can be depressed to force the resilient tongue of the plug member away from the pin to release the aperture so as to disengage the buckle assembly.

Although the device to Anscher may have advanced the art, devices formed in accordance with the teaching of Anscher also includes several drawbacks as well. One drawback found in such devices is that they often include a single hinged plate or button on a top face of the socket. Even though a single hinged plate or button may be conveniently actuated by a caregiver or other individual operating the buckle assembly, the single hinged plate may also be unintentionally actuated by the infant or inadvertently actuated by unintentionally impacting an object. Another drawback found in devices constructed in accordance with Anscher is that Anscher suggests two plugs which are oppositely disposed in along a longitudinal direction of the socket such that belts or the like which are secured to the buckle extend in a horizontal direction about the midsection of the infant. However, it has been found that such an orientation of the belts may not adequately secure an infant who often lacks the strength to support oneself. Alternatively directing the belts upward at an angle in devices such as Anscher often results in unevenly tensioning the belts thereby causing the belts to become jammed.

Other three-piece buckles have been suggested to overcome some of the above disclosed disadvantages. One such device is the buckle assembly disclosed in U.S. Pat. No. 5,813,097 to Woellert et al. Woellert et al. generally discloses a dual tongue buckle which includes a single latch member and a single ejection member housed within the socket, or buckle main body. Each of the tongues include an angled slot for receiving a belt. The device to Woellert et al. may be assembled by advancing each tongue member into the socket individually. Alternatively, the tongues are shaped to fit adjacent one another such that the tongues may be inserted within the socket together.

Although devices formed in accordance with Woellert et al. may advance the art, such devices also have several drawbacks as well. First, Woellert et al. once again includes a single button which simultaneously releases both tongues. As disclosed previously, buckle assemblies which allow for the tongues to be ejected through articulation of a single button substantially increase the likelihood that the buckle assembly is inadvertently actuated thereby inadvertently or unintentionally ejecting the tongues from the socket. Further, the buckle assembly to Anscher includes a plurality of separate parts thereby increasing the manufacturing and assembly costs of such buckles as well as increasing the opportunity for mechanical failure.

Lastly, other devices have been suggested which include a buckle assembly having a pair of tongues wherein the tongues may be registered together before insertion thereby allowing for the tongues to be simultaneously inserted as a single element when such is desirable. One such device of the above mentioned character is described in U.S. Pat. No. 5,283,933 to Wiseman et al. Wiseman suggests a buckle assembly having projections on one of the tongues which are receivable in apertures on the other tongue. Although such devices enhances the ability of the caregiver to maintain the tongues in a proper orientation when it is desirable to simultaneously insert both tongues, such a device would substantially impair the ability of the tongues to be inserted individually when doing so is desirable.

In light of the above, one skilled in the art can best appreciate that several advancements are still desirable. Specifically, it would be desirable to have a buckle assembly which allows the each tongue to be secured within the socket individually or simultaneously together at the option of the caregiver. Secondly, it would be desirable to have a buckle assembly which includes a ejection mechanism which substantially prevents inadvertent and unintentional actuation. Thirdly, it would be desirable to have a buckle assembly which is designed to adequately secure an infant or other similar occupant. Lastly, it would be further desirable to have a device which operates effectively while also reducing the overall number of parts thereby minimizing manufacturing and assembly costs as well as minimizing the opportunity for part failure.

SUMMARY OF THE INVENTION

It is an object of the present invention to provide a buckle assembly which securely retains an occupant to a device.

Another object of the present invention is to provide the buckle assembly with at least two tongues receivable within a socket wherein a caregiver may assemble the tongues individually or simultaneously at the option of the caregiver.

Still another object of the present invention is to provide the buckle assembly with an ejection mechanism which is designed to reduce the opportunity that the tongues are inadvertently actuated.

A further object of the present invention is to minimize the number of parts such that manufacturing and assembly costs as well as undesirable part failure is thereby reduced.

Additional features and advantages of thc invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

According to the present invention, there is provided a buckle assembly which includes at least one tongue. The tongue includes a longitudinal axis having a rearward portion terminating at a first distal end and a forward portion terminating at a second distal end. In addition, the tongue includes a first side and an oppositely disposed second side. Interconnecting the first side and the second side is an inner surface and an outer surface.

One unique aspect of the present invention it that it includes a tongue coupling member. The tongue coupling member includes a cantilever projection. Further, the tongue coupling member includes a depression disposed proximate the cantilever projection. In a preferred embodiment, the at least one tongue is a first tongue and a second tongue sized to be receivable within a socket. The cantilever projection of the first tongue is oriented to be receivable within the depression of the second tongue while the cantilever projection of the second tongue is oriented to be receivable within the depression of the first tongue. Lastly, also in a preferred embodiment, the socket and each tongue of the present invention includes a slot for receiving a belt or strap. Most preferably, the slot of each tongue is angularly skewed relative to the longitudinal axis of the respective tongue.

In use, the caregiver of the present invention is provided with a device which is uniquely configured to securely restrain a occupant such as an infant. Specifically, the present invention includes slots for receiving a belt or strap. The slot of each tongue is angularly skewed relative to the longitudinal axis of the respective tongue. As such, the belt may be directed away from the socket in a direction which is uniquely oriented to increase the ability of the buckle assembly to evenly distribute the stresses realized within the belt to thereby securely restrain the infant. When assembling the buckle assembly of the present invention, the caregiver may individually insert the first tongue, or the second tongue, into the socket. As such, the caregiver can utilize their other hand as needed such as for supporting the infant while manipulating the buckle assembly. When inserting the second tongue, or the first tongue depending on which tongue is inserted first, into the socket, the cantilever projection will flex inward and slid along the inner surface of the second tongue, while the cantilever projection of the first tongue will similarly be flexed inward by the inner surface of the first tongue. Once the cantilever projection of the first tongue is adjacent the depression of the second tongue and the cantilever projection of the second tongue is adjacent the depression of the first tongue, the tongues will spring outward to their pre-deformed position such that the respective cantilever projection is disposed with the respective depression. Alternatively, the caregiver may place each tongue together before insertion into the socket such that the cantilever projection of the first tongue is received within the depression of the second tongue and the cantilever projection of the second tongue is received within the depression of the first tongue. As such, the tongues are properly aligned relative to one another such that the tongues may be simultaneously inserted together. Once the caregiver desires to eject the tongues from the socket, the tongues must be ejected simultaneously since the interaction between the respective cantilever projection and depression of each tongue operates to substantially interconnect, or lock, the tongues together.

One skilled in the art can best appreciate that the above described invention provides several advantages over the prior art. Specifically, the present invention includes a slot on each tongue which is angularly skewed relative to the longitudinal axis of the respective tongue. Therefore, the belts may be directed away from the respective tongue at an angle which operates to securely retain the child.

Another advantage of the present invention is that the caregiver of this device is provided with a far more convenient and versatile buckle assembly than heretofore known in the art. Specifically, the caregiver may assembly the buckle assembly by inserting each tongue into the socket individually when doing so is convenient. However, the caregiver may align each tongue adjacent one another, or register the tongues relative to one another, such that the tongues may be inserted into the socket simultaneously.

Still another advantage of the present invention is that when each tongue is ejected from the socket, both tongues must be released simultaneously since the projections and depressions operate to interconnect the respective tongues. Accordingly, the present invention increases the safety of such a device over that previously know in the art. Namely, an individual tongue may not be inadvertently ejected unless both tongues are simultaneously ejected.

Lastly, yet another advantage of the present invention is that it preferably includes merely three members: the first tongue, the second tongue, and the socket. One skilled in the art can best appreciate that utilization of merely three members substantially reduces manufacturing as well as assembly costs. Further, part minimization reduces the opportunity for mechanical failure as well.

DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DESCRIPTION OF THE PREFERRED EMBODIMENT

Reference will now be made in detail to the preferred embodiments of the present invention, examples of which are illustrated in the accompanying drawings. Wherever possible, the same reference numbers will be used throughout the drawings to refer to the same or like parts. The invention will now be further clarified by the following example, which is intended to be purely exemplary of the invention.

Figure 1:
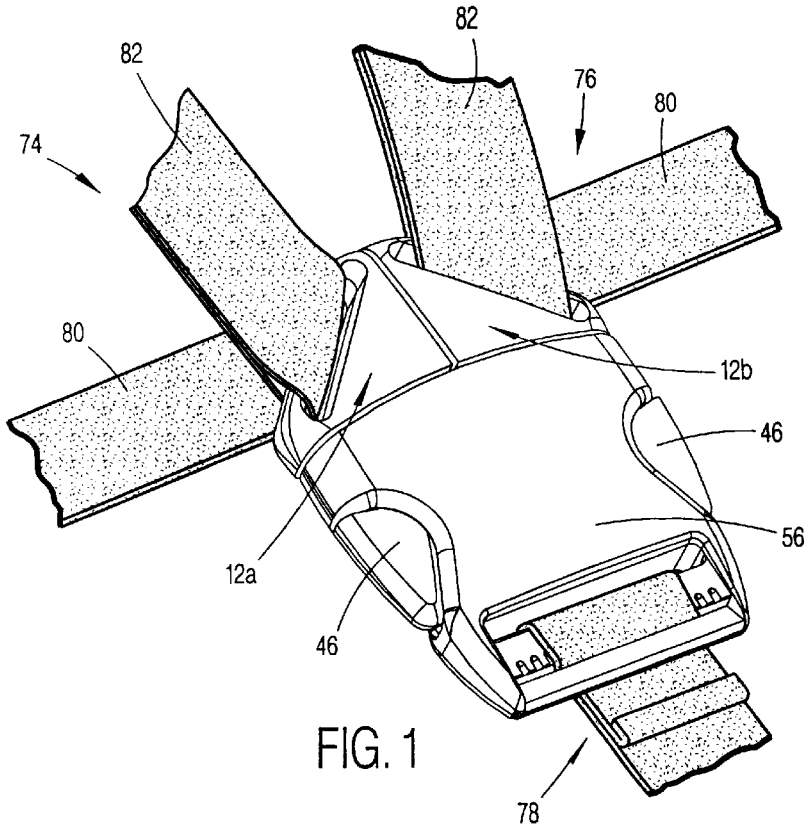
FIG. 1 is a perspective view of the buckle assembly of the present invention including a pair of tongues coupled to the socket member and a belt extending from each of the tongues and the socket.

According to the present invention, there is provided a buckle assembly 10 for securing an occupant to a device, not shown. The buckle assembly 10 has at least one tongue 12 (the reference number 12 being used when discussing a single tongue or the common features thereof). Preferably, as best appreciated with reference to FIG. 1, the at least one tongue is a first tongue 12*a* and a second tongue 12*b* (the reference numbers 12*a*, and 12*b* being used when specifically discussing the first tongue or second tongue or the interaction therebetween). As best appreciated with reference to FIG. 3, FIG. 4, FIG. 5, and FIG. 6, each tongue 12 includes a longitudinal axis along having a rearward portion 14 terminating at a first distal end 16 and a forward portion oppositely 18 disposed relative to the rearward portion 14 along the longitudinal axis and terminating at a second distal end 20. Further, each tongue 12 includes a first side 22 and an oppositely disposed second side 24. Interconnecting the first side 22 and the second side 24 is an inner surface 26 and an outer surface 28 oppositely disposed relative to the inner surface 26.

Figure 7:
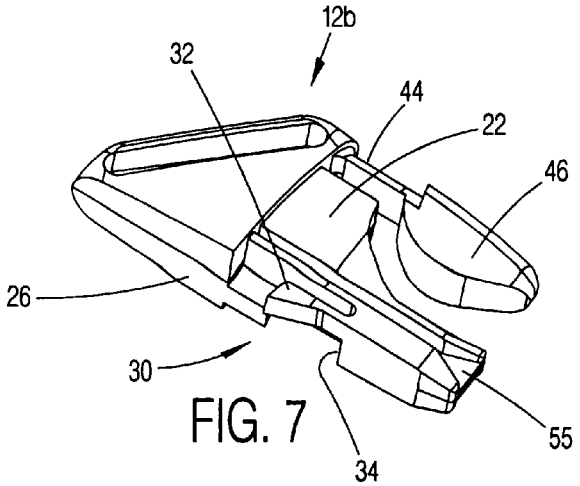
FIG. 7 is a bottom perspective view of a second tongue.

As seen in FIG. 7, one unique aspect of the present invention is that each tongue 12 includes a tongue coupling member 30 disposed on the inner surface 26 of the respective tongue 12. The tongue coupling member 30 includes a cantilever projection 32 and a depression 34 disposed adjacent the cantilever projection 32. As best appreciated with reference to FIG. 4, the cantilever projection 12 is disposed on the inner surface 26 proximate the first side 22. The depression 34 is also disposed on the inner surface 26 yet disposed proximate the second side 24. The depression preferably includes a wall 36. The cantilever projection 32 includes an outwardly angled face 38 which terminates at an end 40. Preferably, the wall 36 and the end 40 are correspondingly angled. As best appreciated with reference to FIG. 8, the cantilever projection 32 of the first tongue 12*a* is receivable within the depression 34 of the second tongue 12*b*. Similarly, the cantilever projection 32 of the second tongue 12*b* is receivable within the depression 34 of the first tongue 12*a*. Accordingly, the first tongue 12*a* and the second tongue 12*b* are thereby properly aligned, or registered, relative to one another by the abutment of the end 40 of the cantilever projection 32 with the wall 36 of each corresponding depression 34.

Each tongue 12 also includes a securement member 42. The securement member 42 includes a cantilever arm 44 extending from the rearward portion 14 of the tongue 12 and defining a portion of the forward portion 18 of the tongue 12. Extending from the cantilever arm 44 is a button. The button 46 includes an inwardly angled surface 48. Disposed between the cantilever arm 44 and the button 46 is a shoulder 50.

Figure 5:
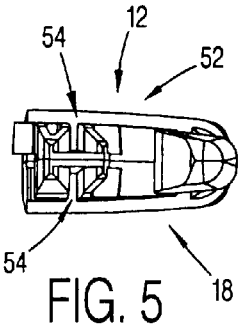
FIG. 5 is a front elevational view of one of the tongues.
Figure 6:
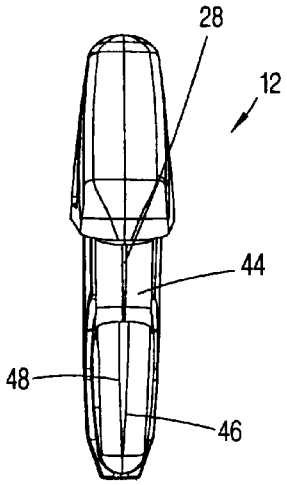
FIG. 6 is an outside elevational view of one of the tongues.
Figure 8:
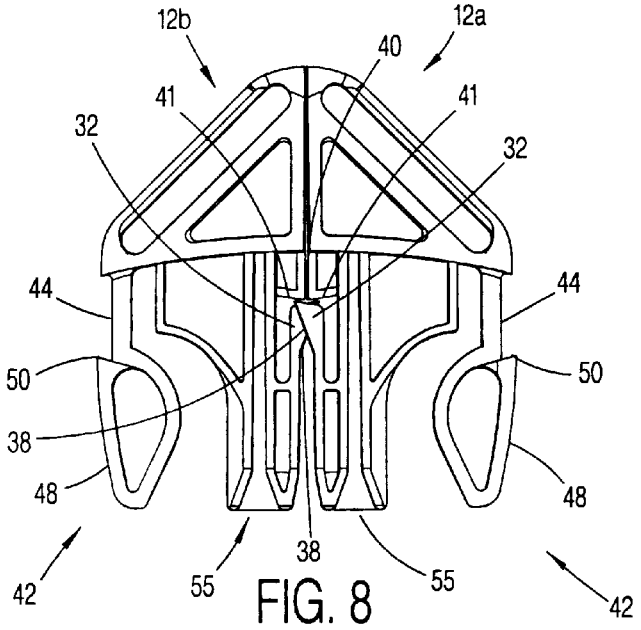
FIG. 8 is a top plan view of the first tongue and the second tongue of the present invention disposed adjacent one another.

As seen in FIG. 8, each tongue 12 of the present invention includes an alignment member 52. The alignment member 52 extending from the rearward portion 14 of the tongue 12 and defining a portion of the forward portion 18 of the tongue 12. Preferably, the alignment member 52 includes at least one U-shaped groove 54. Preferably, each alignment member 52 includes at least one U-shaped groove 54. Each U-shaped groove 54 including a tapering portion 55 proximate the second distal end 16 of each tongue 12. Most preferably, each U-shaped groove 54 is a pair of U-shaped grooves 54 on each tongue 12 oriented relative to one another such that the alignment member 52 is generally H-shaped as seen in FIG. 5.

Figure 9:
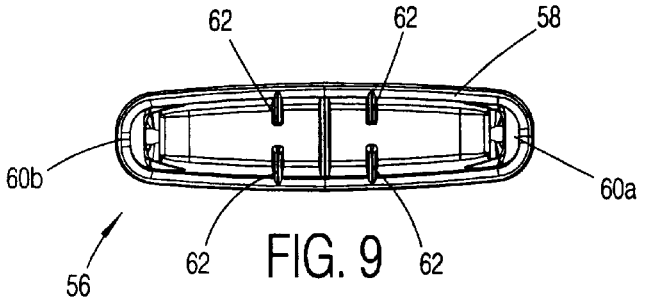
FIG. 9 is a front elevational view of the socket.
Figure 10:
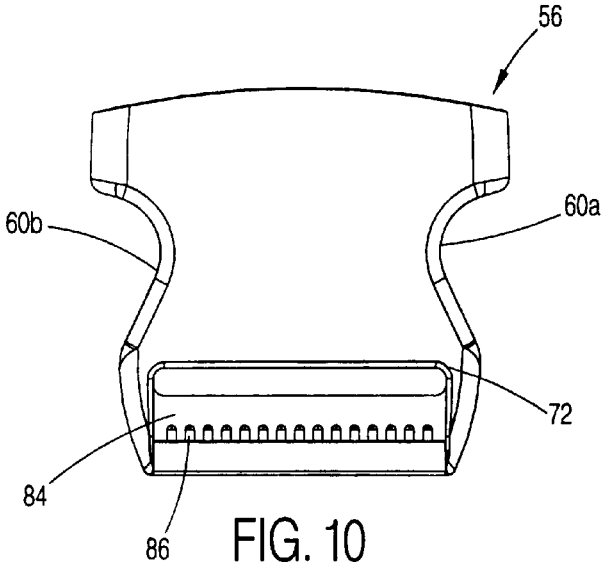
FIG. 10 is a top plan view of the socket of the present invention.
Figure 11:
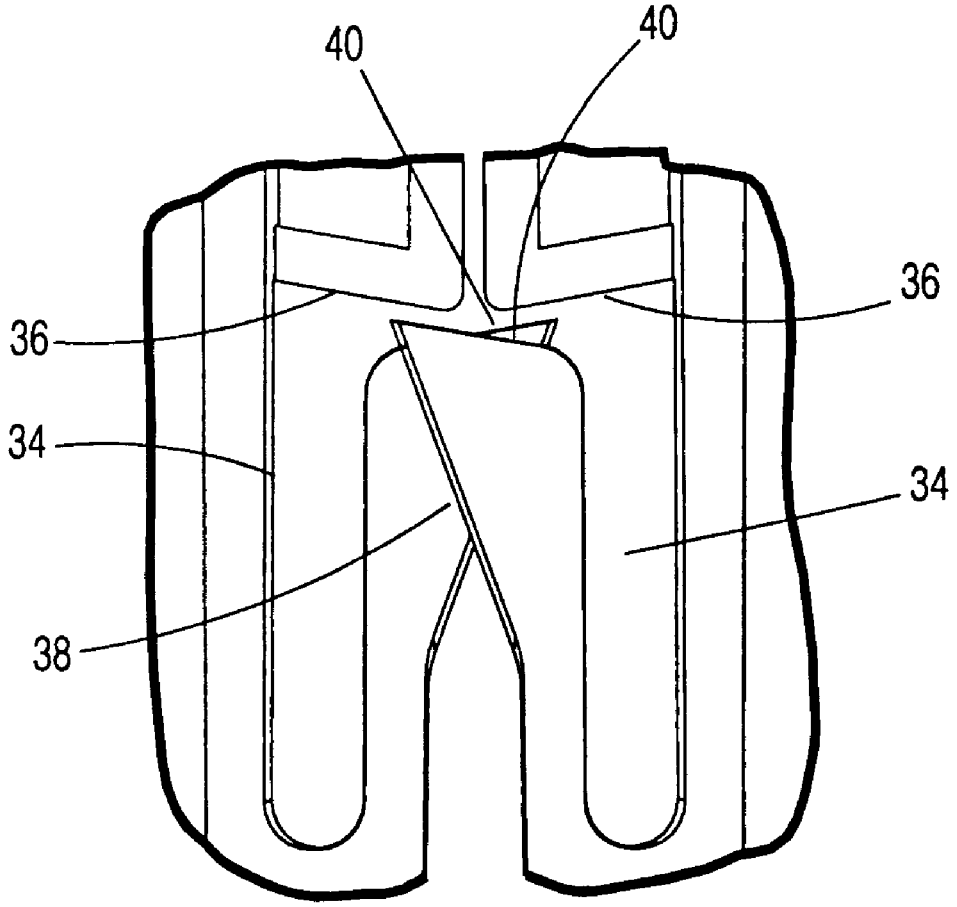
FIG. 11 is a front elevational detailed view of the engaging components of the first tongue and the second tongue of the present invention.

The buckle assembly 10 of the present invention also includes a socket 56 having a cavity 58. As shown in FIG. 10, the socket 56 preferably includes a pair of openings 60*a*, 60*b* sized to receive a button 46 of the corresponding tongue 12*a*, 12*b*. Lastly, the socket 56 includes a plurality of alignment ribs 62 disposed within the cavity 58. As shown in FIG. 9, the alignment ribs 62 are preferably two pair of alignment ribs 62. It being understood that each pair of alignment ribs 62 being oriented to receive the pair of U-shaped grooves 54 of each corresponding tongue 12.

The buckle assembly 10 of the present invention further includes a mechanism for securing a plurality of belts 64 to the buckle assembly 10. Preferably, the mechanism for securing belts 64 includes a first slot 68 disposed through the first tongue 12*a*, a second slot 70 disposed through the second tongue 12*b*, and a third slot 72 disposed through the socket 56. Preferably, the first slot 68 and the second slot 70 are disposed through the rearward portion of each respective tongue 12. One unique aspect of this invention is that the first slot 68 and the second slot 70 are angularly skewed relative to the longitudinal axis of the respective tongue 12. Most preferably, the first slot 68 and the second slot 70 are each angularly skewed towards the inner surface 26 by approximately 45 degrees relative to the longitudinal axis of the respective tongue 12. The first belt 74 and the second belt 76 may be secured to the device by feeding each belt 74, 76 through the respective slot 68, 70 such that each belt 74, 76 defines a first portion 80 and a second portion 82. The first portion 80 may be secured to the device, not shown, at a location distanced apart from the second portion 82. Lastly, the socket 56 includes a gripping bar 84 disposed within the third slot 72. Most preferably, the griping bar 84 includes a serrated edge 86 thereby enhancing the ability of the gripping bar 84 to grip the third belt 78.

In use, a caregiver is presented with a buckle assembly which is substantially versatile and easily manipulated. The above disclosed invention is uniquely configured for use with devices such as strollers, car seats, and the like which are commonly utilized to restrain an infant. Since infants often lack the ability to support oneself, the caregiver often is required to support the infant with one hand while manipulating the buckle assembly 10. The present invention allows the caregiver to secure each tongue 12 either individually or simultaneously to the socket 56 at the option of the caregiver. Specifically, the caregiver may insert the first tongue 12*a* into the socket 56. (One skilled in the art can best appreciate that the precise order that the tongues 12 are inserted into the socket 56 is immaterial as such the second tongue 12*b* may be inserted into the socket 56 first at the option of the caregiver.) In so doing, the pair of alignment grooves 54 are oriented to receive the corresponding pair of alignment ribs 62. As such, the first tongue 12*a* is properly aligned as the caregiver inserts the first tongue 12*a* into the socket 56. Further, the each U-shaped groove 54 includes a tapered portion 55 to assist in properly aligning the respective pair of U-shaped members 54 with the corresponding pair of alignment ribs 62. As the first tongue 12*a* is further inserted into the cavity 58, the button 46 will abut the cavity 58. As the caregiver further urges the first tongue 12*a* into the socket 56, the button 46 will slide along the inwardly angled surface 48. The first tongue 12*a* is substantially prevented from becoming misaligned due to the interaction of the alignment member 52 and the alignment ribs 62 thereby urging the cantilever arm 44 to flex inward as the caregiver further inserts the first tongue 12*a* into the socket 56. Once the button 46 is disposed adjacent the respective opening 60*a*, the button 46 will spring back into its preflexed state such that the shoulder 50 abuts at least a portion of the opening 60*a*.

Next, the caregiver may then insert the second tongue 12*b* once again orienting the corresponding alignment member 52 with the correspond pair of alignment ribs 62. The alignment ribs 62 once again assist in assuring that the second tongue 12*b* is properly aligned as it is inserted by the caregiver. As the second tongue 12*b* is inserted into the socket 56, the button 46 abuts the cavity 58. As the caregiver further urges the second tongue 12*b* into the socket 56, the button 46 will flex inwardly. In addition, the cantilever projection 32 of the second tongue 12*b* first abuts the inner surface 26 of the first tongue 12*a*. Then approximately simultaneously with the flexing of the button 46 the cantilever projection 32 is flexed inward by the inner surface 26 of the first tongue 12*a*. The caregiver further urges the second tongue 12*b* into the socket 56 until the button 46 is proximate the respective opening 60*b*. Once so oriented, the cantilever arm 44 will flex back to its pre-flexed state such that the shoulder 50 abuts at least a portion of the respective opening 60*b* thereby securing the second tongue 12*b* to the socket 56.

Figure 2:
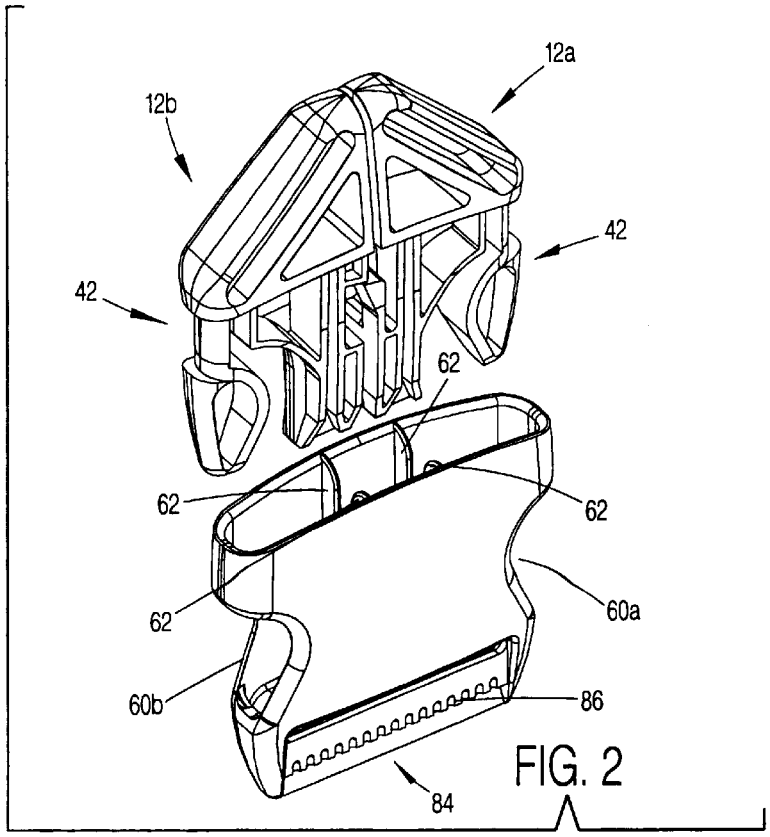
FIG. 2 is a perspective view of the buckle assembly with the tongues removed from the socket and adjacent one another.
Figure 3:
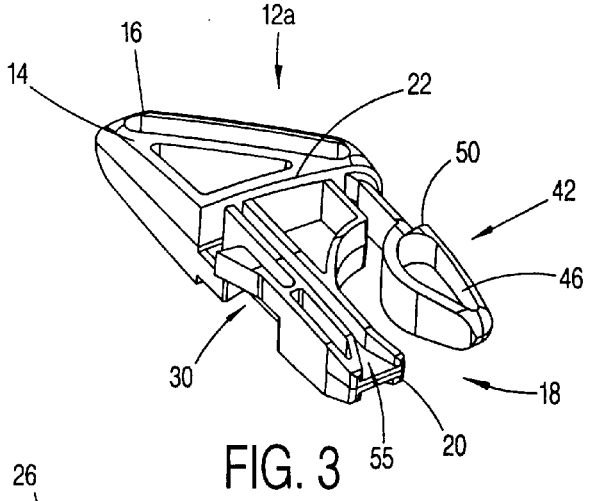
FIG. 3 is a top perspective view of a first tongue.
Figure 4:
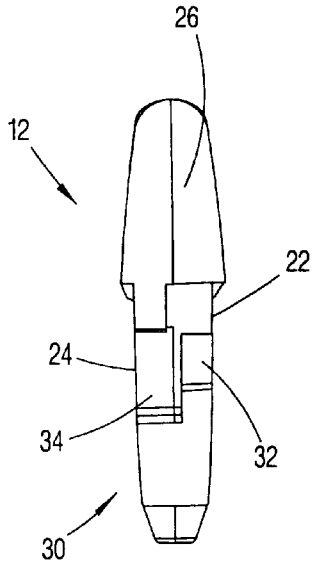
FIG. 4 is an elevational view of one of the tongues.

Alternatively, the user may insert the respective tongues 12*a*, 12*b* into the socket 56 substantially simultaneously. To do so, the caregiver will abut the first tongue 12*a*, and the second tongue 12*b*. Specifically, the caregiver will insert the cantilever projection 32 of the first tongue 12*a* at least partially within the corresponding depression 34 of the second tongue 12*b* as well as insert the cantilever projection 32 of the second tongue 12*b* at least partially within the corresponding depression 34 of the first tongue 12*a*. Once each tongue 12*a*, 12*b* are properly disposed adjacent one another as shown in FIG. 2, the caregiver may approximately simultaneously insert both tongues 12 into the socket 56. As such, the button 46 of both the first tongue 12*a* and the second tongue 12*b* are thereby flexed as described above until the button 46 of both the first tongue 12*a* and the second tongue 12*b* are disposed proximate the respective opening 60*a*, 60*b* and thereby spring into their pre-deformed orientation thereby securing the first tongue 12*a* and second tongue 12*b* with the socket 56.

To release the tongues 12*a*, 12*b* from the socket 56, the caregiver must approximately simultaneously actuate the button 46 of both the first tongue 12*a* and the second tongue 12*b* thereby flexing the cantilever arm 44 of each tongue 12*a*, 12*b* inward until the shoulder 50 of each tongue 12*a*, 12*b* is capable of escaping the corresponding opening 60*a*, 60*b*. Once in this orientation, the cavity 58 is capable of abutting the inwardly angled surface 48 of each button 46. Due to the flexed orientation of each cantilever arm 44 and the inwardly angled surface 48 of each button 46, each tongue 12*a*, 12*b* is thereby urged out of the cavity 58 until the cantilever arm 44 regains its pre-flexed orientation.

One advantage of the above described invention is that provides the caregiver with a buckle assembly 10 which substantially enhances the ability of the buckle assembly 10 to securely retain an occupant. Specifically, the angled orientation of the first slot 58 on the first tongue 12*a* and the angled orientation of the second slot 60 of the second tongue 12*b* allow the first belt 74 and the second belt 76 to be directed upward and over the shoulders of the occupant. In a preferred embodiment, the first belt 74 and the second belt 76 may have the first portion 80 directed around the mid-section of the infant while the second portion 82 is directed over the shoulders of the infant. Further, the present invention include a third belt 78 which is oriented to be directed between the legs of the infant. As such, the buckle assembly 10 of the present invention operates to provide a substantially five-point securement for the infant: around each side of the infant, over each should of the infant, and between the legs of the infant.

Another advantage of the present invention is that the buckle assembly 10 provides the caregiver with a substantial amount of versatility when attempting to properly secure each tongue 12*a*, 12*b* to the socket 56. Specifically, the caregiver may individually insert each tongue 12*a*, 12*b* into the socket 56. Alternatively, the caregiver may insert both tongues 12*a*, 12*b* into the socket 56 together.

Yet another advantage of the present invention is that each of the tongues 12*a*, 12*b* may be released from the socket 56 only upon the approximately simultaneous actuation of the button 46 of each tongue 12*a*, 12*b*. Although the tongues may be inserted individually, when doing so is desired by the caregiver, the tongues must be ejected together. To say it another way, actuation of a single button on one of the tongues 12 is not sufficient to allow the tongue 12 to be ejected. This advantage is achieved by the interaction of the cantilever projection 32 and the depression 34 on each of the tongues 12. Specifically, once secured with the socket 56, the end 40 of the first tongue 12*a* abuts the wall 36 of the second tongue 12*b*. Similarly, the end 40 of the second tongue 12*b* abuts the wall 36 of the first tongue 12*a* thereby preventing each tongue 12*a*, 12*b* from sliding relative to one another. As such, both tongues 12*a*, 12*b* will remain secured within the socket 56 until the button 46 of each tongue 12*a*, 12*b* is actuated.

Still another advantage of the present invention is that the buckle assembly 10 preferably includes merely three members. Specifically, the buckle assembly 10 includes a first tongue 12*a*, a second tongue 12*b*, and a socket 56. Therefore, one skilled in the art can best appreciate the above mentioned advantages are achieved while also minimizing manufacturing and assembly costs as well as reducing the opportunity for mechanical failure.

While the above describes the preferred embodiment of the invention, the invention is not intended to be so limited. Other embodiments, which will be apparent to those skilled in the art, which utilize the teachings herein set forth, are intended to be within the scope of the present invention.

What is claimed is:

1. A buckle comprising:

a socket having a tongue receiving opening and a pair of release button openings;

a pair of buckle assemblies adapted to be inserted into the socket, each buckle assembly having an outer end including a slot for receiving a belt and a tongue;

each tongue including a cantilever arm having a release button arranged to protrude through one of the socket release button openings when the tongue is inserted in the socket; and each tongue further including a tongue coupling member arranged to engage the other tongue when both tongues are inserted in the socket and to prevent removal of either tongue unless both release buttons are depressed to allow simultaneous removal of both buckle assemblies from the socket.

2. The buckle of claim 1 wherein the tongue coupling member includes a cantilevered projection having an end and wherein each tongue includes a depression for receiving the cantilevered projection of the other tongue.

3. The buckle of claim 2 wherein the projection end includes an angled face and the depression includes a mating angled face.

4. The buckle of claim 1 further comprising at least two alignment ribs within the socket and a groove on each buckle assembly arranged to slide over the ribs to align the tongue coupling members.

5. The buckle of claim 1 wherein each tongue includes a longitudinal axis and each slot is angularly skewed with respect to such axis.

* * * * *